US010871048B2

(12) United States Patent
Hardesty et al.

(10) Patent No.: US 10,871,048 B2
(45) Date of Patent: Dec. 22, 2020

(54) CONTROLLED BYPASS PLUG AND METHOD

(71) Applicant: GEODYNAMICS, INC., Millsap, TX (US)

(72) Inventors: John T. Hardesty, Fort Worth, TX (US); Philip M. Snider, Tomball, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 168 days.

(21) Appl. No.: 16/133,856

(22) Filed: Sep. 18, 2018

(65) Prior Publication Data

US 2019/0136656 A1 May 9, 2019

Related U.S. Application Data

(60) Provisional application No. 62/583,056, filed on Nov. 8, 2017.

(51) Int. Cl.

| | |
|---|---|
| ***E21B 33/12*** | (2006.01) |
| ***E21B 33/129*** | (2006.01) |
| ***E21B 33/128*** | (2006.01) |
| ***E21B 34/14*** | (2006.01) |

(52) U.S. Cl.

CPC ..... *E21B 33/12* (2013.01); *E21B 33/128* (2013.01); *E21B 33/1293* (2013.01); *E21B 34/14* (2013.01)

(58) Field of Classification Search

CPC ... E21B 33/129; E21B 33/1294; E21B 33/134
See application file for complete search history.

(56) References Cited

U.S. PATENT DOCUMENTS

| | | | | |
|---|---|---|---|---|
| 1,859,648 | A | 5/1932 | Baker | |
| 2,118,176 | A * | 5/1938 | Dunlap | F04F 1/18 166/112 |
| 6,427,773 | B1 | 8/2002 | Albers | |
| 9,062,543 | B1 | 6/2015 | Snider et al. | |
| 9,243,472 | B1 | 1/2016 | Snider et al. | |
| 9,752,406 | B2 | 9/2017 | Hardesty et al. | |
| 9,835,006 | B2 | 12/2017 | George et al. | |

(Continued)

FOREIGN PATENT DOCUMENTS

WO 2016114800 A1 7/2016

OTHER PUBLICATIONS

International Search Report (Forms PCT/ISA/220 and PCT/ISA/210), dated Nov. 23, 2018, for International Application No. PCT/US2018/051453.

(Continued)

*Primary Examiner* — D. Andrews
(74) *Attorney, Agent, or Firm* — Patent Portfolio Builders PLLC

(57) ABSTRACT

A composite plug for sealing a well includes a mandrel having an internal bore, the mandrel having a first end and a second end, opposite to the first end, and the bore extending from the first end to the second end; plural elements distributed along the mandrel in a given order and configured to seal the well; and a bypass mechanism, different from the bore, built into the composite plug and configured to allow a controlled leak of a fluid from the well, past the composite plug.

12 Claims, 15 Drawing Sheets

(56) References Cited

U.S. PATENT DOCUMENTS

| | | | |
|---|---|---|---|
| 10,180,037 | B2 | 1/2019 | Hardesty et al. |
| 10,480,276 | B2 | 11/2019 | Snider et al. |
| 2010/0230094 | A1 | 9/2010 | Foster et al. |
| 2011/0259610 | A1 | 10/2011 | Shkurti et al. |
| 2013/0112408 | A1 | 5/2013 | Oxtoby |
| 2013/0133891 | A1 | 5/2013 | Getzlaf et al. |
| 2014/0060812 | A1 | 3/2014 | Young et al. |
| 2016/0230498 | A1* | 8/2016 | Walton ..... E21B 33/1294 |
| 2017/0314361 | A1 | 11/2017 | Rosenthal |
| 2018/0171741 | A1 | 6/2018 | Snider et al. |

OTHER PUBLICATIONS

Written Opinion of the International Searching Authority (Form PCT/ISA/237), dated Nov. 23, 2018, for International Application No. PCT/US2018/051453.

* cited by examiner

CONTROLLED BYPASS PLUG AND METHOD

BACKGROUND

Technical Field

Embodiments of the subject matter disclosed herein generally relate to downhole tools related to perforating and/or fracturing operations, and more specifically, to a plug having a bypass mechanism for allowing well fluids to bypass the plug.

Discussion of the Background

In the oil and gas field, after a well 100 is drilled to a desired depth H relative to the surface 110, as illustrated in FIG. 1, and the casing 102 protecting the wellbore 104 has been installed and cemented in place, it is time to connect the wellbore 104 to the subterranean formations 106 to extract the oil and/or gas. This process of connecting the wellbore to the subterranean formations may include a step of plugging the well with a plug 112 and a step of making holes 116 into the casing.

The step of plugging the well requires to lower into the well 100 a wireline 118, which is electrically and mechanically connected to a perforating gun assembly 114, which in turn is attached to a setting tool 120. The setting tool is configured to set the plug at the desired location. Setting tool 120 is configured to hold the plug 112 prior to plugging the well. FIG. 1 shows the setting tool 120 disconnected from the plug 112, indicating that the plug has been set in the casing and the setting tool 120 has been disconnected from the plug 112.

FIG. 1 shows the wireline 118, which includes at least one electrical connector, being connected to a control interface 122, located on the ground 110, above the well 100. An operator of the control interface may send electrical signals to the setting tool for (1) setting the plug 112 and (2) disconnecting the setting tool from the plug. After the plug has been set and the holes 116 in the casing have been made, the setting tool 120 is taken out of the well and a ball 122 is typically inserted into the well to fully close the plug 112. When the plug is closed, a fluid 124, (e.g., water, water and sand, fracturing fluid, etc.) may be pumped by a pumping system 126, down the well for fracturing purposes.

The above operations may be repeated multiple times for perforating and/or fracturing the casing at multiple locations, corresponding to different stages associated with underground formations 108 and 109. Note that in this case, multiple plugs 112 and 112' may be used for isolating the respective stages from each other during the perforating phase and/or fracturing phase.

During fracturing or other completion operations, it is desired to completely shut down one or more stages of the well. This is achieved by installing one or more plugs. However, the plugs 200 have, as shown in FIG. 2, an internal bore 202 that allows a fluid to pass through the plug. FIG. 2 also shows the other components of the plug, i.e., a mandrel 204, a push ring 206, an upper slip ring 208, an upper wedge 210, a sealing element 212, a lower wedge 214, a lower slip ring 216, and a mule shoe 218. The mandrel 204 supports all these components. The push ring 206, when pressed by the setting tool (or a setting kit), moves the upper wedge 210 under the upper slip ring 208, thus breaking the upper slip ring 208 and pressing its various parts against the casing. The same action happens for the lower slip ring 216 and the lower wedge 214. The sealing element 212 is pressed between the two wedges, thus expanding radially and sealing the well. In this regard, note that an external diameter of the plug before being set is smaller than an interior diameter of the casing, so that the plug can be moved inside the well at the desired location prior to the setting operation.

Because of the internal bore 202, fluid inside the well is able to pass through the plug. When desired to fracture a stage of the well and the plug 200 needs to be completely shut, a ball 220 is lowered into the well. The ball 220 moves under the pressure of the fluid in the well until it encounters the plug 200. The ball 220 is designed to fit into a seat 222 formed in the plug (in the mandrel 204), and seals the interior of the plug. At this time the plug is fully shut.

However, practical observations in the field indicate that a fully shut plug is more prone to failure. Also, plugs that are not fully shut leak fluid in an unknown manner, which is undesirable. Thus, there is a need to provide a better plug that is able to allow a controlled amount of fluid to bypass the plug.

SUMMARY

According to an embodiment, there is a composite plug for sealing a well and the composite plug includes a mandrel having an internal bore, the mandrel having a first end and a second end, opposite to the first end, and the bore extending from the first end to the second end; plural elements distributed along the mandrel in a given order and configured to seal the well; and a bypass mechanism, different from the bore, built into the composite plug and configured to allow a controlled leak of a fluid from the well, past the composite plug.

According to another embodiment, there is a composite plug for sealing a well, the composite plug including a mandrel having an internal bore, the mandrel having a first end and a second end, opposite to the first end, and the bore extending from the first end to the second end; a sealing element located on the mandrel and configured to seal a space between an exterior of the plug and the well; and a bypass mechanism, different from the bore, built into the composite plug and configured to allow a controlled leak of a fluid from the well, past the sealing element.

According to still another embodiment, there is a method of manufacturing a pack with controlled bypass flow. The method includes the steps of providing a mandrel having an internal bore, the mandrel having a first end and a second end, opposite to the first end, and the bore extending from the first end to the second end; adding a push ring to the mandrel, adjacent to the first end; adding a slip ring to the mandrel, adjacent to the push ring; adding an upper wedge to the mandrel, adjacent to the slip ring; adding a sealing element to the mandrel, adjacent to the upper wedge; adding a lower wedge to the mandrel, adjacent to the sealing element; adding a lower slip ring to the mandrel, adjacent to the lower wedge; adding a mule shoe on the mandrel, adjacent to the lower slip ring; and making a bypass mechanism, different from the bore, into the composite plug, that allows a controlled leak of a fluid from the well, past the composite plug.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a composite plug. However, the embodiments discussed herein are applicable to other plugs, e.g., big bore plug, non-composite plugs, bridges, etc.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

As discussed above, it has been observed that plugs that fully seal the well have a tendency to fail. In addition, the present inventors have observed that various procedures associated with a plugged well are better performed when there is a controlled fluid bypassing the plug, i.e., a regulated amount of the well fluid is still allowed to pass through the plug when the plug is set. Thus, according to an embodiment, a plug is manufactured to have at least one controlled bypass mechanism that allows a desired amount of fluid to pass through the plug when fully set. In the following embodiments, the bypass mechanism is implemented as: (1) one or more conduits extended through a mandrel, along the mandrel, through a sealing element, in a seat of a ball, through the ball, or (2) two seats that use different balls, or (3) a seat and two different balls, or (4) a seat and a deformable ball. Each of these possible implementations are now discussed with regard to the figures.

Figure 1:
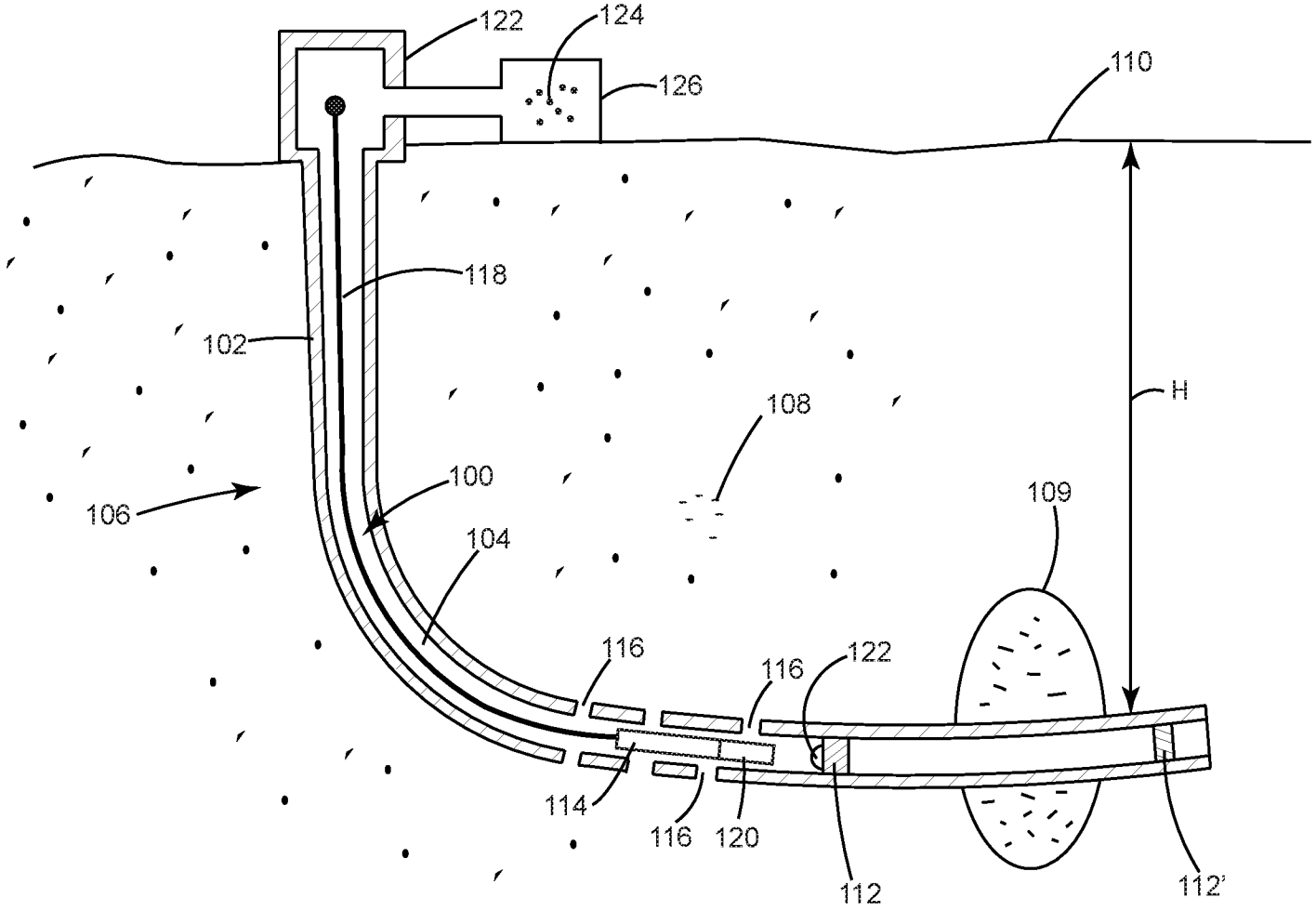
FIG. 1 illustrates a well and associated equipment for well completion operations.
Figure 2:
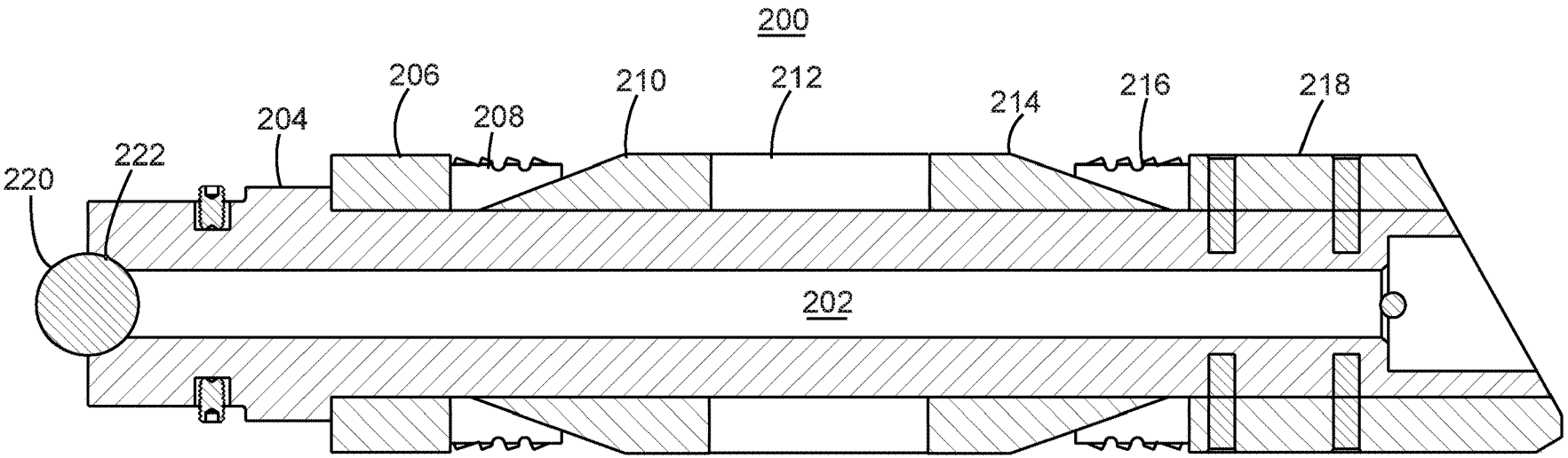
FIG. 2 illustrates a traditional composite plug.
Figure 3:
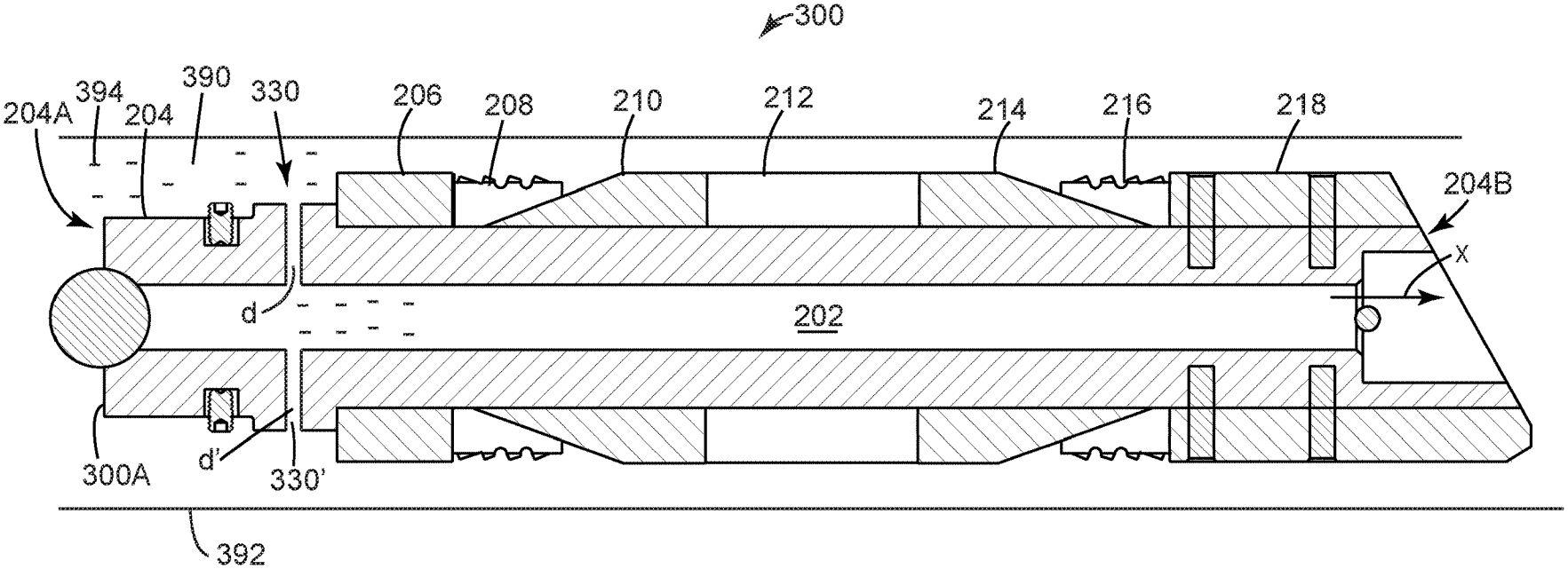
FIG. 3 illustrates a composite plug with a bypass mechanism formed in a mandrel.

As illustrated in FIG. 3, according to one embodiment, a composite plug 300 has at least one conduit 330 formed through a wall of the mandrel 204. Mandrel 204 has an upper end 204A (the term "upper" in this application indicates that the end is closer to a top of the well than a bottom of the well) and a lower end 204B (the term "lower" in this application indicates that the end is closer to a bottom of the well than a top of the well). Conduit 330 may be formed anywhere between the upper end 204A and the push ring 206. In one application, the conduit 330 may be formed anywhere between the end 204A and the sealing element 212. Conduit 330 permits the bore 202 to fluidly communicate with the inside 390 of the casing 392 so that a fluid 394 present in the well can bypass the plug 300, in both directions (i.e., upward and downward), when the plug is set.

A diameter d of the conduit 330 is selected during the manufacturing of the plug so that the amount of fluid bypassing the plug, when the plug is set, is not so large that the effectiveness of the plug is hindered. Actual diameters of the conduit depend on the diameter of the well, the depth of the plug, the operation for which the plug is installed, and so on. For example, the diameter of the plug may be larger than zero and smaller than 3 cm.

Figure 4:
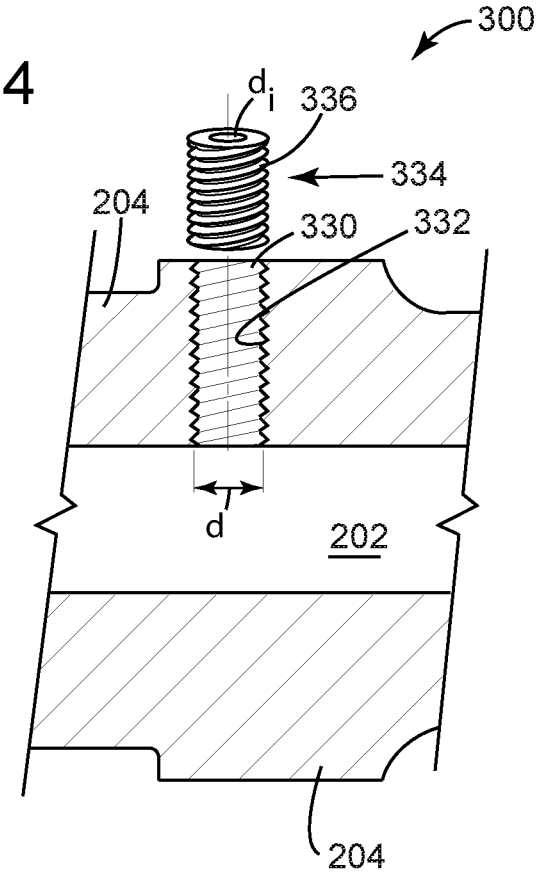
FIG. 4 illustrates an adapter that can be attached to the bypass mechanism.

A portion of the mandrel 204 and the conduit 330 are shown in detail in FIG. 4. In this embodiment, conduit 330 has internal threads 332 that mate with external threads 336 of an adapter element 334. Adapter element 334 has an internal diameter d1, smaller than the internal diameter d of the conduit 330. With this adapter, if the original conduit 330 made in the mandrel 204 is too large for a given job, by adding an appropriate adapter element 334, the amount of fluid that bypasses the plug when the plug is set may be reduced (i.e., controlled).

Returning to FIG. 3, it is possible that more than one conduits 330 are formed in the mandrel. An optional (additional) conduit 330' is shown in FIG. 3. This conduit may have an internal diameter d', which may be the same or different from the internal diameter d of the conduit 330. In one embodiment, the two or more conduits 330 and 330' are aligned with each other, i.e., they are made in the mandrel at the same position along an axis X. In another embodiment, the two or more conduits are staggered along axis X. In still another application, the two or more conduits are made to be substantially perpendicular to the X axis. In yet another application, the two or more conduits make an angle with the X axis, for example, smaller than 90 and larger than zero. In one application, the one or more conduits are located only between an upper end 300A of the plug 300 (which in some embodiments coincide with the upper end of the mandrel) and the push ring 206. While these embodiments have been discussed with regard to a composite plug (i.e., a plug that has its elements made mostly of composite materials), the novel features introduced herein are also applicable to non-composite plugs, mixed plugs, metal plugs, etc.

Figure 5:
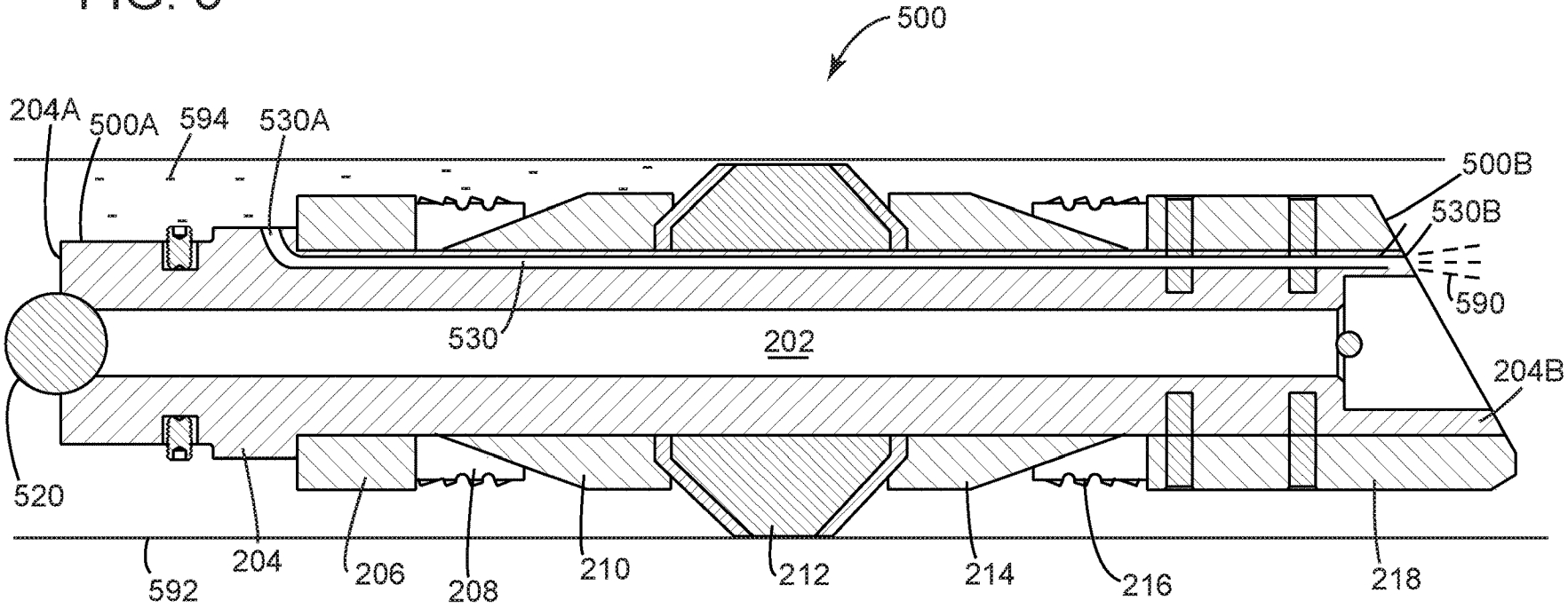
FIG. 5 illustrates a composite plug with a bypass mechanism formed along a mandrel.

In another embodiment illustrated in FIG. 5, it is possible that instead of making the one or more conduits through the body of the mandrel 204, as illustrated in the embodiments of FIGS. 3 and 4, to make the one or more conduits 530 along the mandrel 204, in the body of the mandrel. Plug 500 has one or more conduits 530 (only one shown for simplicity, but those skilled in the art would understand that more than one conduit may be made) formed along the mandrel 204. An upper end 530A of the conduit 530 may be formed next to the upper end 500A of the plug and a lower end 530B of the conduit may be formed at the lower end 500B of the plug. In one application, the upper end 530A of the conduit is located next to the push plug 206 while the lower end 530B of the conduit is located next to the mule shoe 218.

Figure 6:
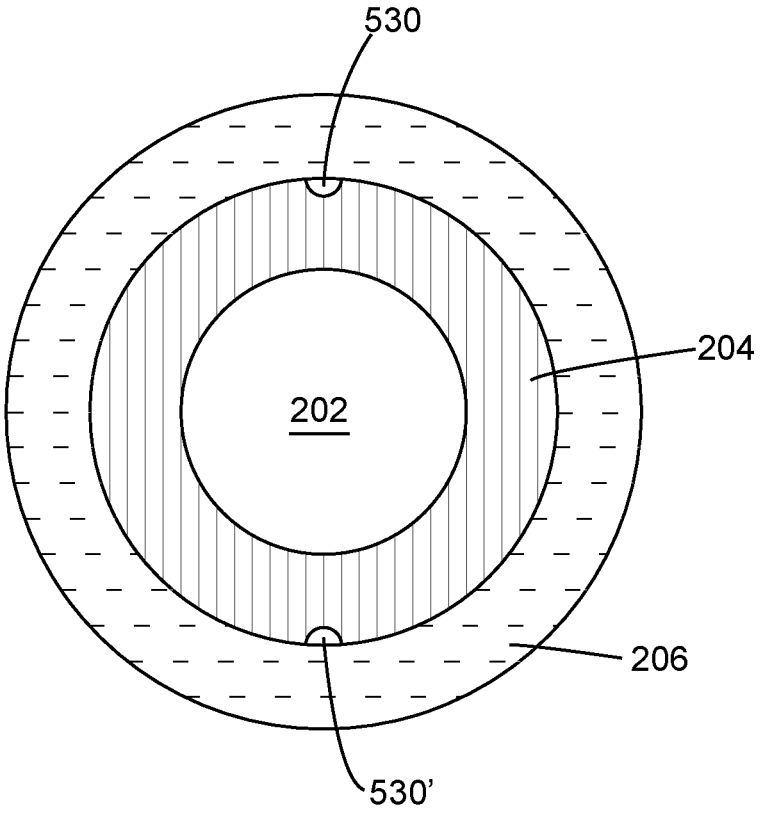
FIG. 6 is a cross-section of the plug shown in FIG. 5.

When the plug 500 is set as shown in FIG. 5 (i.e., sealing element 212 is fully extended and ball 520 is in its seat), the fluid 594 inside casing 592 can flow only through conduit 530, from upper end 530A to lower end 530B or vice versa. FIG. 6 shows a cross-section through the plug 500 shown in FIG. 5, to better illustrate how two conduits 530 and 530' are formed in the body of the mandrel 204. The shape and sizes of the one or more conduits 530 can vary and depend on the details of the well, the plug and the functions performed in the well. Similar to the embodiment illustrated in FIG. 4, it is possible to add an adapter either to the upper end 530A or the lower end 530B or both, of the conduit 530, if the amount of fluid bypassing the plug needs to be adjusted. Conduit 530 does not have to extend all the way along the mandrel as shown in FIG. 5. For example, in one embodiment, it is possible to make a channel into the mandrel to extend only between the two wedges and allow the fluid to enter the channel next to one of the wedges.

Figure 7:
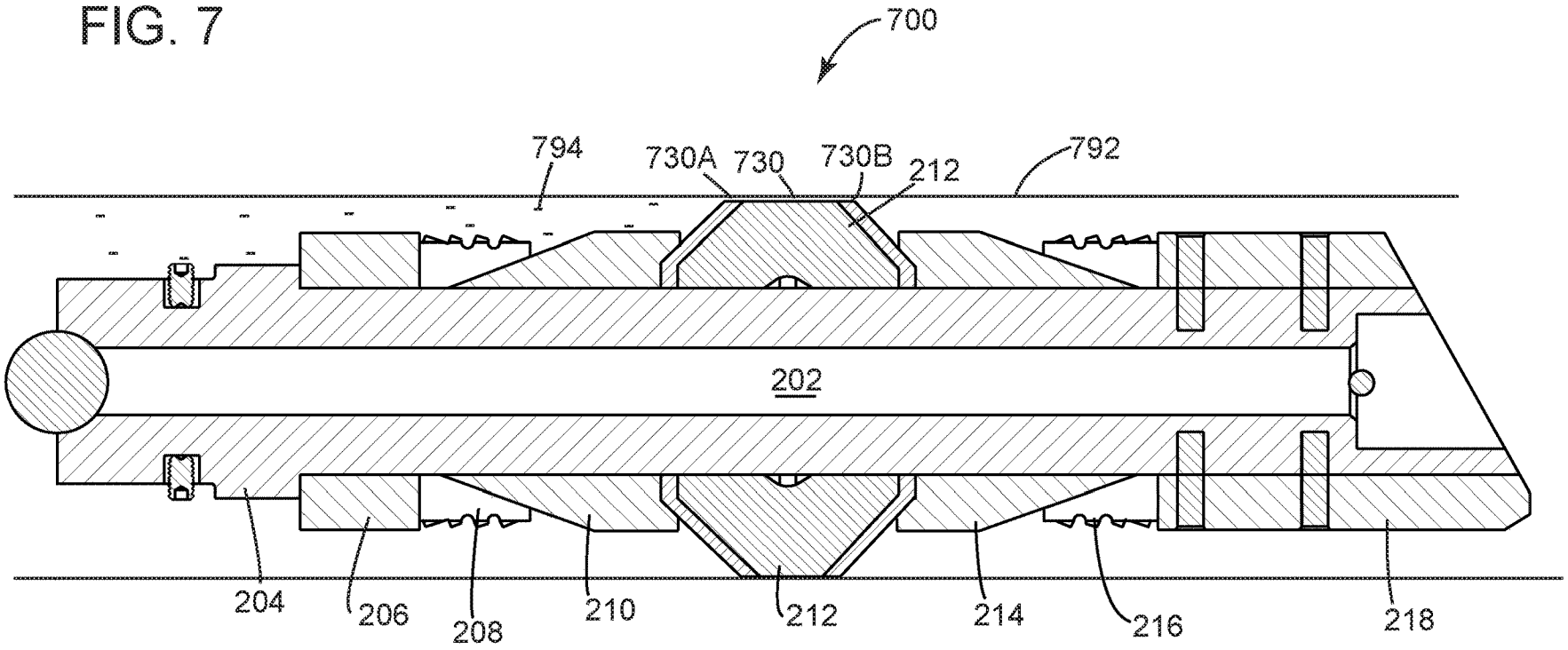
FIG. 7 illustrates a composite plug with a bypass mechanism formed in a sealing element.
Figure 8:
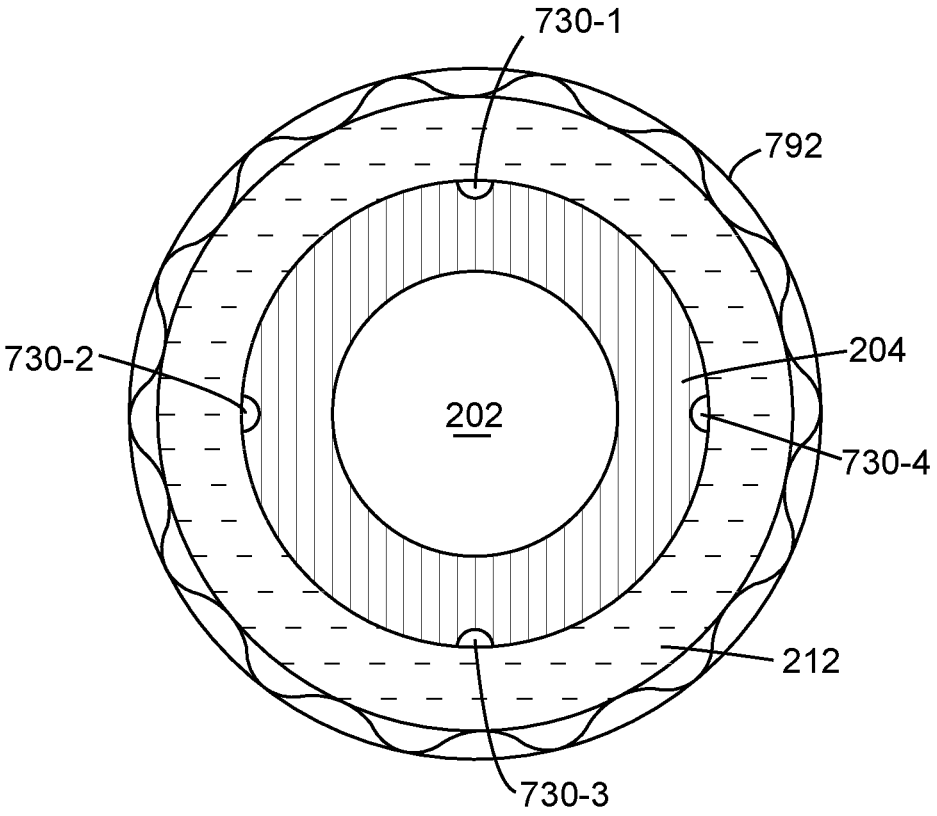
FIG. 8 is a cross-section of the plug shown in FIG. 7.

According to another embodiment, it is possible to form the conduits into the sealing element 212. FIG. 7 shows such an embodiment in which sealing element 212 is fully extended to engage the casing 792 (note that some of the features shown in this figure are exaggerated for illustrating various points) while a conduit 730, formed in the body of the sealing element, allows a small amount of fluid 794 to bypass the plug. Conduit 730 has an upper end 730A and a lower end 730B. Conduit 730 (more conduits are possible) is illustrated in cross-section in FIG. 8. FIG. 8 shows four such conduits 730-1 to 730-4. The conduits may be distributed symmetrically or not around the sealing element 212. In one application, the conduits 730 are made of another material (e.g., metal) than the body of the sealing element for maintaining the conduits open even when the sealing element is fully deployed (i.e., compressed).

Figure 9A:
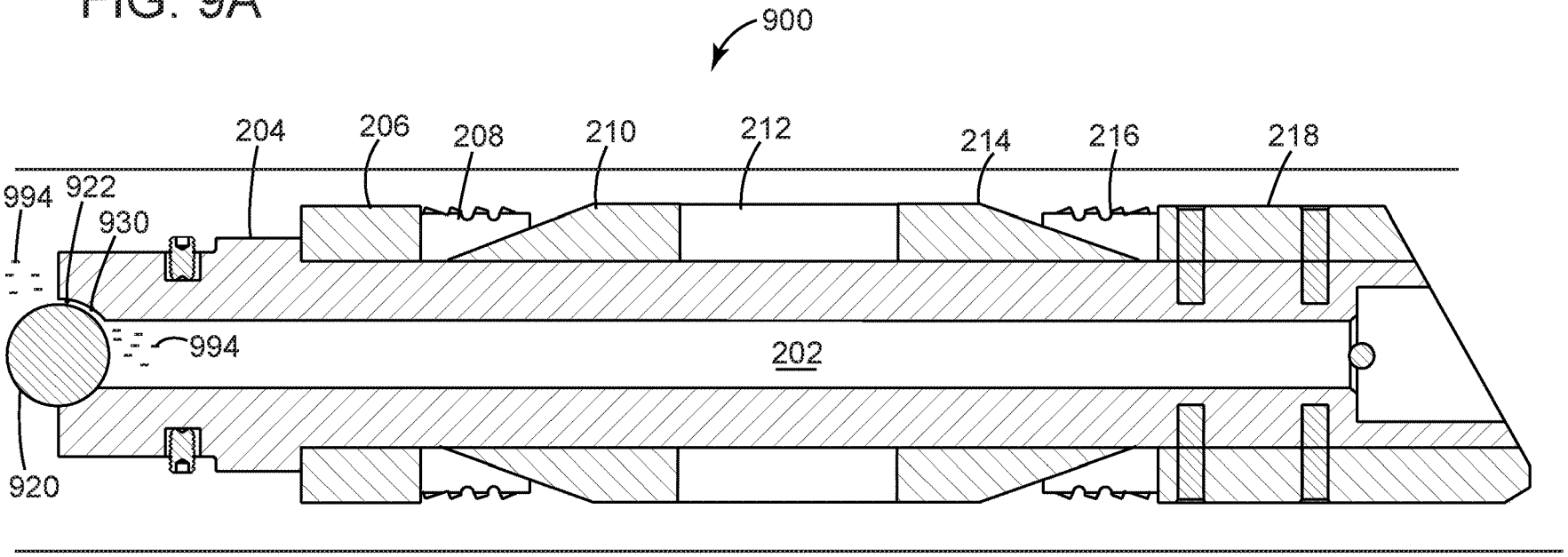
FIG. 9A illustrates a composite plug with a bypass mechanism formed in a seat of a mandrel.

In still another embodiment, the conduits are formed in the seat of the ball. More specifically, as illustrated in FIG. 9A, seat 922, which is machined to perfectly mate with corresponding ball 920, has at least one conduit 930 that allows the fluid 994 to bypass the ball, and consequently, the plug 900. The size of the conduit can vary from plug to plug, depending on the requirements of the completion operations for a given well. More than one conduit may be made in the seat 920.

Figure 9B:
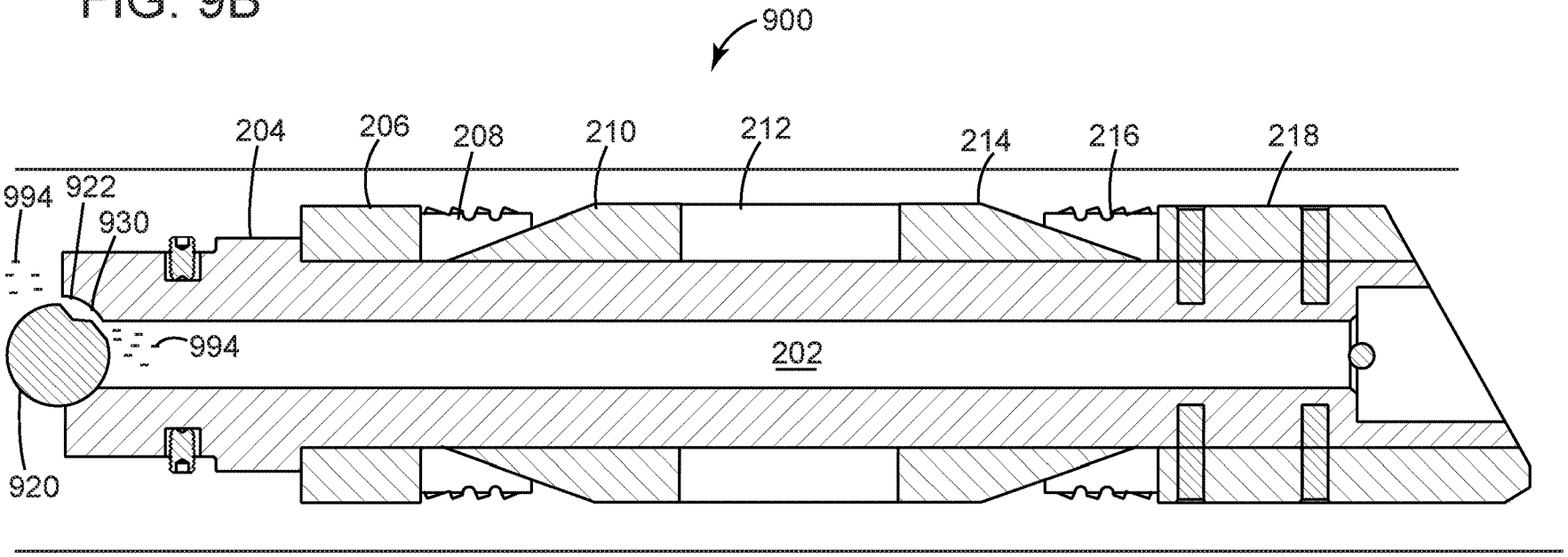
FIG. 9B illustrates a composite plug with a bypass mechanism formed in a ball that works with a mandrel.

In a related embodiment, instead of making the conduits in the seat 920, it is possible to make the conduits 940 in the ball 920, as illustrated in FIG. 9B. If only one conduit is made in the ball, it is possible that the conduit will not face the seat, and thus, no controlled fluid bypass is achieved. To prevent this possibility, plural conduits 940 are formed in the ball so that there is at least one conduit facing seat 922 when the ball is in place. In one embodiment, the conduits 940 may be achieved by forming the ball to have plural flat faces, like a golf ball. In this case, the flat faces facing the seat do not fully seal the flow of fluid. Those skilled in the art would know, based on the enclosed teachings, to implement other variations of these conduits for allowing the fluid inside the well to bypass the plug.

The above discussed conduits in the various embodiments may be made to be more dynamic, i.e., to allow an active tuning of the amount of fluid that passes through these conduits. In this regard, a valve or similar element that has an adjustable internal diameter may be attached to the one or more conduits for adjusting the fluid flow. The valve may have a rotation component that increases or decreases the internal diameter of the valve, so that the amount of fluid flowing through the valve may be adjusted. This adjustable valve or rotating element may be added to any of the bypass mechanisms discussed herein.

In one embodiment, after a conduit is made in the plug as discussed above, a leak profile of the conduit(s) may be experimentally measured. Thus, the operator of the well has the choice of selecting a plug with a known leak profile for various downhole operations. A plug with a bypass conduit is more advantageous than a conventional plug, which might leak unintentionally, because it is better to know the leak profile of the used plug instead of using one with an unknown leak profile.

In one application, the controlled bypass conduit may interact with sand present in the well. This interaction could either reduce the effectiveness of the conduit once a significant sand pack is built above the plug (this would happen with a conduit or ported bypass) or the conduit could be designed to continue to bypass fluid, even with a sand pack in place, when an engineered restriction, such as a Lee Screen, a viscojet or jevajet (e.g., from Lee Hydraulics) is used.

Figure 10A:
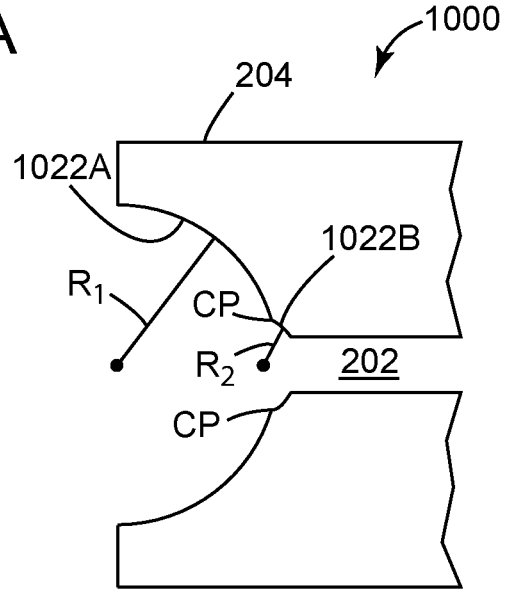
FIGS. 10A-10C illustrate a composite plug with a bypass mechanism that uses two seats and two balls.
Figure 10B:
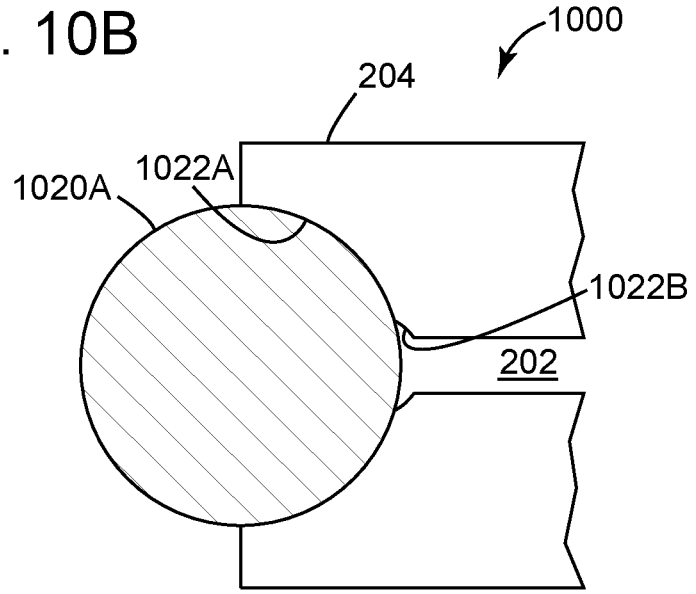
Figure 10C:
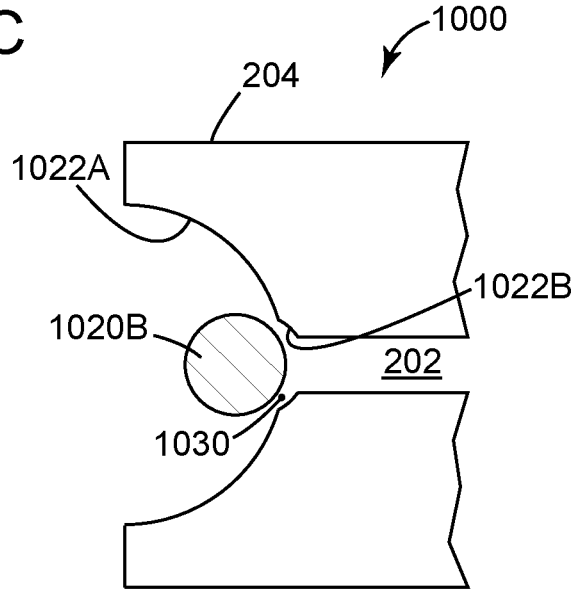

According to another embodiment, it is possible to achieve a controlled bypass flow through the plug by having two seats instead of one as now discussed with regard to FIGS. 10A-10C. FIG. 10A shows a portion of the mandrel 204 of a plug 1000. There are two seats 1022A and 1022B having different sizes. First seat 1022A has a first radius R1 and second seat 1022B has a second radius R2. The two radii R1 and R2 are different. In one embodiment, the first radius is larger than the second radius. In another embodiment, the opposite is true. The two seats 1022A and 1022B are connected to each other as shown in FIG. 10A, i.e., a surface of the first seat is continuous with a surface of the second seat. In one application, the surfaces of the two seats are connected and have an inflection at the connection point CP. The first seat 1022A is configured to mate with a first ball 1020A, as illustrated in FIG. 10B, and the second seat 1022B is configured to mate with a second ball 1020B, as illustrated in FIG. 100. FIG. 100 also shows two conduits 1030 formed in the second seat 1022B for allowing the fluid in the well to bypass the plug. For this embodiment, the operator uses ball 1020A if a full seal of the well is desired and a ball 1020B if a partial seal of the well is desired. Note that a radius of ball 1020A is larger than a radius of ball 1020B. One skilled in the art would understand that this embodiment can be combined with that illustrated in FIG. 9B, i.e., to use a ball with plural planar faces instead of the small ball 1020B to achieve the controlled fluid bypass flow.

Figure 11A:
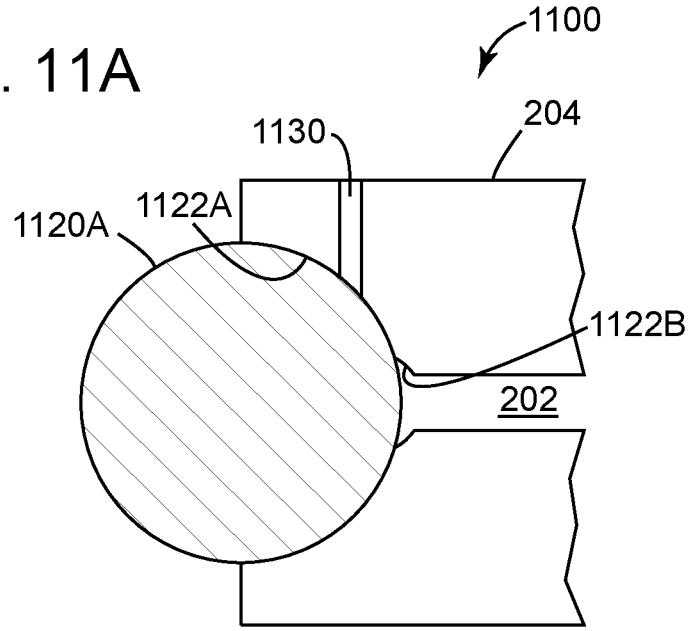
FIGS. 11A-11B illustrate a composite plug with a bypass mechanism that uses one seat and one conduit formed into the seat.

According to yet another embodiment, it is possible to use a single seat, two different balls and one or more conduits to control the bypass fluid flow. FIG. 11A shows a part of the mandrel 204 having a single seat 1122 that mates with a corresponding first ball 1120A to block any fluid flow. Note that one or more conduits 1130 are formed through the mandrel, above the ball, so that the one or more conduits are completely sealed by the first ball 1120A. In other words, the conduit 1130 is formed through a wall of the mandrel 204 so that the conduit 1130 intersects the seat 1122, which is located at the first end of the mandrel. Thus, for the embodiment illustrated in FIG. 11A, there is no fluid bypass flow.

Figure 11B:
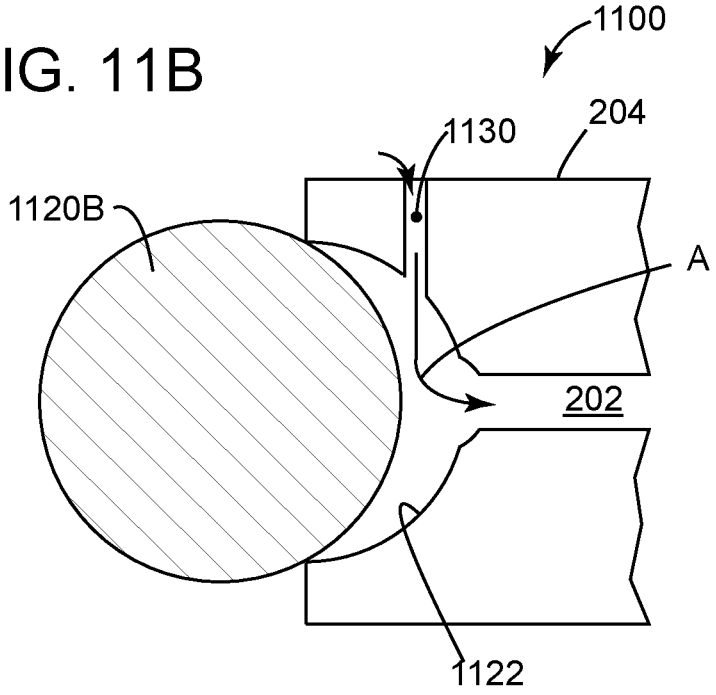

However, as illustrated in the embodiment of FIG. 11B, when a second ball 1120B with a larger radius than the first ball 1120A is used, this ball does not mate well with seat 1122, and thus the conduit 1130 is not blocked. In this case, fluid from the casing can enter conduit 1130 and flow through the bore 202 as indicated by arrow A. Thus, for this embodiment, the operator controls the bypass flow by selecting a small or large ball, the small ball corresponds to no flow and the large ball corresponds to a controlled flow.

The balls used in the embodiments discussed above may be solid balls, i.e., balls that do not deform when an upward pressure is pushing them into their seat. Those skilled in the art would know that any material shows a slight deformation when under a large pressure, which is this case is up to 10,000 psi. This slight deformation is expected and is within normal tolerances of the ball specifications, and thus, this slight deformation is not considered to be an effective deformation.

Figure 12A:
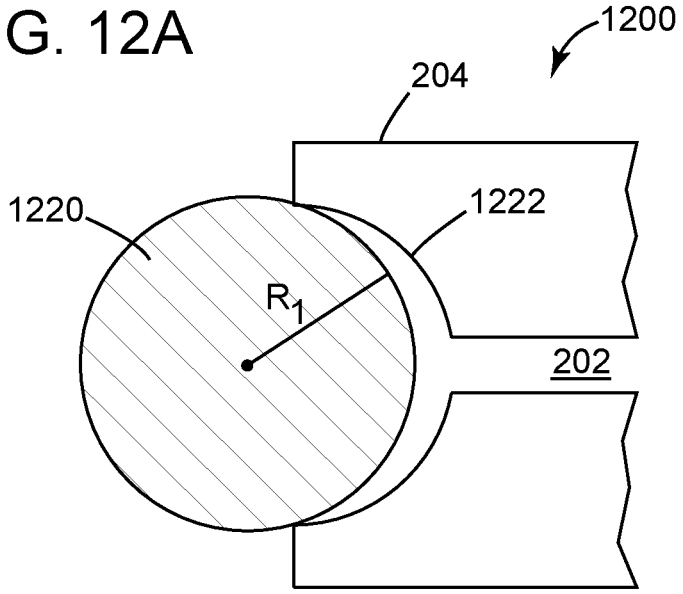
FIGS. 12A-12B illustrate a composite plug with a bypass mechanism that uses a deformable ball.
Figure 12B:
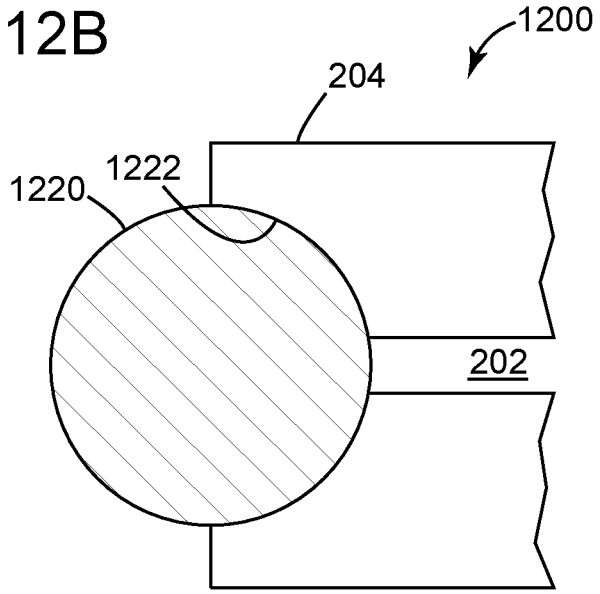

However, according to another embodiment, it is possible to use a deformable ball. Such a ball 1220 may maintain its spherical shape, as illustrated in FIG. 12A, up to a given pressure (e.g., 7,000 psi) and then deform when the pressure is above the given pressure, as illustrated in FIG. 12B. When the ball 1220 deforms as shown in FIG. 12B, the ball mates with the seat 1222, to fully block the fluid bypass. However, the situation is different in the embodiment of FIG. 12A because the ball 1220 does not conform to seat 1222. This means that some fluid is leaking past the ball. In other words, the ball has a spherical shape in FIG. 12A and a non-spherical shape in FIG. 12B, due to the deformation. Such a deformable ball is manufactured from a special material, like solid thermoplastic. The ball may be direct molded. In one embodiment, the ball is non-metallic, or glass-filed, or made of carbon fibers, or nylon or polyether ether ketone (PEEK) or Kevlar.

Figure 13:
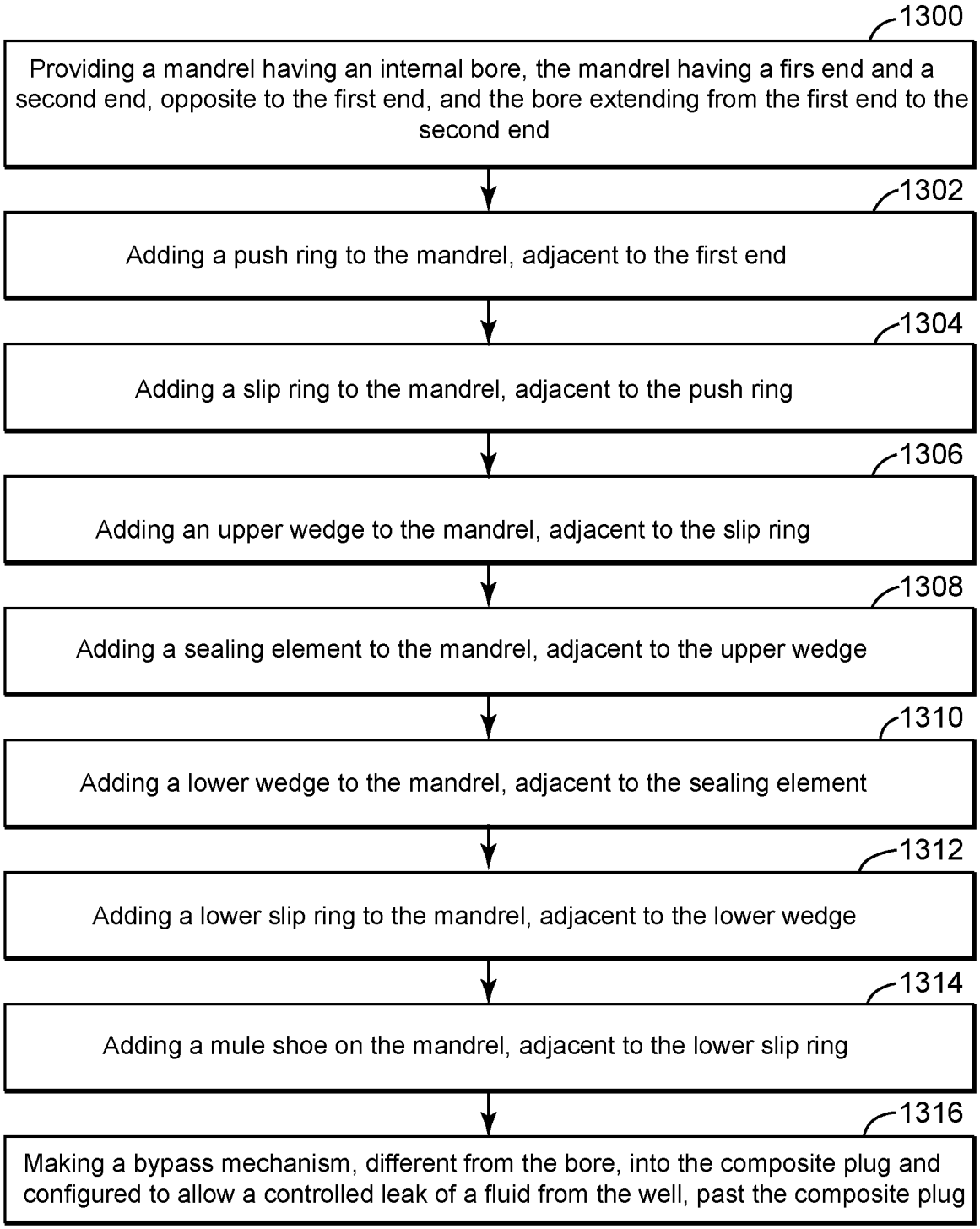
FIG. 13 is a method of manufacturing a composite plug with a bypass mechanism.

A method of manufacturing a pack with controlled bypass flow is now discussed with regard to FIG. 13. The method includes a step 1300 of providing a mandrel 204 having an internal bore 202, the mandrel having a first end 204A and a second end 204B, opposite to the first end, and the bore 202 extending from the first end 204A to the second end 204B, a step 1302 of adding a push ring 206 to the mandrel, adjacent to the first end 204A, a step 1304 of adding a slip ring 208 to the mandrel, adjacent to the push ring, a step 1306 of adding an upper wedge 210 to the mandrel, adjacent to the slip ring, a step 1308 of adding a sealing element 212 to the mandrel, adjacent to the upper wedge, a step 1310 of adding a lower wedge 214 to the mandrel, adjacent to the sealing element, a step 1312 of adding a lower slip ring 216 to the mandrel, adjacent to the lower wedge, a step 1314 of adding a mule shoe 218 on the mandrel, adjacent to the lower slip ring, and a step 1316 of making a bypass mechanism 330, different from the bore 202, into the composite plug and configured to allow a controlled leak of a fluid from the well, past the composite plug. In one application, the bypass mechanism includes at least one conduit that communicates with the bore is extends along an exterior wall of the mandrel. In one application, in step 1316, instead of making the bypass mechanism, it is possible to use a ball that does not fit exactly to its seat. In this case, the fluid bypasses the composite plug. To suppress this leak, it is possible to pump sand or an acid to make the ball to fit exactly to its seat.

The disclosed embodiments provide methods and systems for providing a pack with controlled bypass flow. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A composite plug for sealing a well, the composite plug comprising:

a mandrel having an internal bore, the mandrel having a first end and a second end, opposite to the first end, and the bore extending from the first end to the second end;

plural elements distributed along the mandrel in a given order and configured to seal the well; and a bypass mechanism, different from the bore, built into the composite plug and configured to allow a controlled leak of a fluid from the well, past the composite plug, wherein the first end of the mandrel has (i) a first seating, having a first radius R1, and (ii) a second seating, having a second radius R2, different from radius R1, wherein the bypass mechanism includes at least one conduit formed in the second seating, and wherein the first seating is configured to receive a first ball to achieve a full seal, and the second seating is configured to receive a second ball, smaller than the first ball, to achieve the controlled leak through the bypass mechanism.

2. The composite plug of claim 1, further comprising:

an adapter that connects to the bypass mechanism and adjusts a flow of the fluid through the bypass mechanism.

3. The composite plug of claim 1, wherein the plural elements comprises:

a push ring located on the mandrel, adjacent to the first end, a slip ring located on the mandrel, adjacent to the push ring;

a wedge located on the mandrel, adjacent to the slip ring; and a sealing element located on the mandrel, adjacent to the wedge.

4. The composite plug of claim 1, further comprising:

the second ball.

5. The composite plug of claim 4, wherein the second ball has plural planar faces to allow the fluid in the well to leak into the bore of the mandrel.

6. The composite plug of claim 1, wherein the at least one conduit is configured to allow a fluid in the well to move between the first end of the mandrel to an inside of the bore of the mandrel.

7. The composite plug of claim 1, wherein a surface of the first seat is continuous with a surface of the second seat.

8. The composite plug of claim 1, wherein there is an inflection point between surfaces of the first and second seats.

9. The composite plug of claim 1, further comprising:

the first ball; and the second ball, wherein the first seating mates with the first ball but not with the second ball.

10. The composite plug of claim 1, wherein the plural elements comprise:

a push ring located on the mandrel, adjacent to the first end;

an upper slip ring located on the mandrel, adjacent to the push ring;

an upper wedge located on the mandrel, adjacent to the upper slip ring, and configured to push the upper slip ring and break the upper slip ring into parts;

a sealing element located on the mandrel, adjacent to the upper wedge, and configured to seal the well;

a lower wedge located on the mandrel, adjacent to the sealing element;

a lower slip ring located on the mandrel, adjacent to the lower wedge, and configured to be pushed by the lower wedge and break into parts; and a mule shoe located on the mandrel, adjacent to the lower slip ring.

11. A composite plug for sealing a well, the composite plug comprising:

a mandrel having an internal bore, the mandrel having a first end and a second end, opposite to the first end, and the bore extending from the first end to the second end;

a sealing element located on the mandrel and configured to seal a space between an exterior of the plug and the well; and a bypass mechanism, different from the bore, built into the composite plug and configured to allow a controlled leak of a fluid from the well, past the sealing element, wherein the first end of the mandrel has (i) a first seating, having a first radius R1, and (ii) a second seating, having a second radius R2, different from radius R1, wherein the bypass mechanism includes at least one conduit formed in the second seating, and wherein the first seating is configured to receive a first ball to achieve a full seal, and the second seating is configured to receive a second ball, smaller than the first ball, to achieve the controlled leak through the bypass mechanism.

12. A method of manufacturing a composite plug with controlled bypass flow, the method comprising:

providing a mandrel having an internal bore, the mandrel having a first end and a second end, opposite to the first end, and the bore extending from the first end to the second end;

adding a push ring to the mandrel, adjacent to the first end;

adding a slip ring to the mandrel, adjacent to the push ring;

adding an upper wedge to the mandrel, adjacent to the slip ring;

adding a sealing element to the mandrel, adjacent to the upper wedge;

adding a lower wedge to the mandrel, adjacent to the sealing element;

adding a lower slip ring to the mandrel, adjacent to the lower wedge;

adding a mule shoe on the mandrel, adjacent to the lower slip ring; and making a bypass mechanism, different from the bore, into the composite plug, that allows a controlled leak of a fluid from thea well, past the composite plug, wherein the first end of the mandrel has (i) a first seating, having a first radius R1, and (ii) a second seating, having a second radius R2, different from radius R1, wherein the bypass mechanism includes at least one conduit formed in the second seating, and wherein the first seating is configured to receive a first ball to achieve a full seal, and the second seating is configured to receive a second ball, smaller than the first ball, to achieve the controlled leak through the bypass mechanism.

* * * * *